US010107073B2

(12) United States Patent
Cramer et al.

(10) Patent No.: US 10,107,073 B2
(45) Date of Patent: Oct. 23, 2018

(54) SYSTEM, METHOD AND APPARATUS FOR CONTROLLING FLUID FLOW THROUGH DRILL STRING

(71) Applicant: General Downhole Technologies Ltd., Calgary (CA)

(72) Inventors: David S. Cramer, Okotoks (CA); Michael J. Harvey, Calgary (CA)

(73) Assignee: General Downhole Technologies Ltd., Calgary (CA)

( * ) Notice: Subject to any disclaimer, the term of this patent is extended or adjusted under 35 U.S.C. 154(b) by 0 days.

(21) Appl. No.: 15/082,185

(22) Filed: Mar. 28, 2016

(65) Prior Publication Data

US 2016/0208576 A1 Jul. 21, 2016
US 2018/0010422 A9 Jan. 11, 2018

Related U.S. Application Data

(63) Continuation of application No. 13/926,391, filed on Jun. 25, 2013, now Pat. No. 9,328,576.

(60) Provisional application No. 61/690,346, filed on Jun. 25, 2012.

(51) Int. Cl.

| | |
|---|---|
| ***E21B 34/10*** | (2006.01) |
| ***E21B 34/14*** | (2006.01) |
| ***E21B 21/10*** | (2006.01) |
| ***E21B 45/00*** | (2006.01) |

(52) U.S. Cl.
CPC ..... *E21B 34/10* (2013.01); *E21B 21/103* (2013.01); *E21B 45/00* (2013.01)

(58) Field of Classification Search
CPC ..... E21B 21/103; E21B 34/10; E21B 34/14
See application file for complete search history.

(56) References Cited

U.S. PATENT DOCUMENTS

| | | | |
|---|---|---|---|
| 3,454,089 | A | 7/1969 | Brown |
| 4,055,338 | A | 10/1977 | Dyer |
| 4,508,174 | A | 4/1985 | Skinner et al. |
| 4,645,007 | A | 2/1987 | Soderberg |
| 4,768,598 | A | 9/1988 | Reinhardt |
| 4,856,756 | A | 8/1989 | Combs |
| 5,479,988 | A | 1/1996 | Appleton |
| 6,263,969 | B1 | 7/2001 | Stoesz |
| 6,325,151 | B1 | 12/2001 | Vincent et al. |
| 6,328,112 | B1 | 12/2001 | Malone |
| 6,550,541 | B2 | 4/2003 | Patel |
| 7,523,792 | B2 | 4/2009 | El-Rayes et al. |
| 7,757,781 | B2 | 7/2010 | Hay et al. |
| 7,845,416 | B2 | 12/2010 | Turner et al. |

(Continued)

FOREIGN PATENT DOCUMENTS

| | | | |
|---|---|---|---|
| AU | 2007257708 | A1 | 12/2007 |
| CN | 101787858 | A | 7/2010 |

(Continued)

*Primary Examiner* — Catherine Loikith

(57) ABSTRACT

A device for limiting the flow of drilling fluid through a section of drill string includes a body with a hole in the periphery. Flow enters the device through one axial end, at least a portion of the flow exits through the other axial end. Some of the fluid flow can be diverted through the peripheral hole. A spring-biased axial piston may have an approximately constant force throughout its range of travel. The piston moves axially in response to the changing fluid flow rate to enable a constant amount of flow exiting the axial end of the tool to be achieved while diverting away excess flow through the side.

19 Claims, 6 Drawing Sheets

(56) References Cited

U.S. PATENT DOCUMENTS

| | | | |
|---|---|---|---|
| 8,194,667 | B2 | 6/2012 | Belgaied et al. |
| 8,323,115 | B2 | 12/2012 | Hocking |
| 8,826,993 | B2 | 9/2014 | Guidry et al. |
| 2001/0001429 | A1 | 5/2001 | Webb |
| 2004/0055743 | A1 | 3/2004 | Vann |
| 2004/0256113 | A1 | 12/2004 | LoGiudice et al. |
| 2009/0031784 | A1 | 2/2009 | Koda et al. |
| 2009/0056952 | A1 | 3/2009 | Churchill |
| 2011/0036631 | A1 | 2/2011 | Prill et al. |
| 2011/0155379 | A1 | 6/2011 | Bailey |
| 2011/0240300 | A1 | 10/2011 | Cenac |
| 2012/0247832 | A1 | 10/2012 | Cramer |
| 2013/0056283 | A1 | 3/2013 | Wassell et al. |
| 2013/0168092 | A1 | 7/2013 | Evans |
| 2014/0020955 | A1 | 1/2014 | Cramer |

FOREIGN PATENT DOCUMENTS

| | | | |
|---|---|---|---|
| CN | 202165053 | U | 8/2011 |
| WO | 2007146889 | A3 | 12/2007 |
| WO | 2013122987 | A1 | 8/2013 |

SYSTEM, METHOD AND APPARATUS FOR CONTROLLING FLUID FLOW THROUGH DRILL STRING

CROSS-REFERENCE TO RELATED APPLICATION(S)

This application is a continuation and claims priority to U.S. patent application Ser. No. 13/926,391 entitled "SYSTEM, METHOD AND APPARATUS FOR CONTROLLING FLUID FLOW THROUGH DRILL STRING", by David S. Cramer, filed Jun. 25, 2013, which application claims priority under 35 U.S.C. § 119(e) to U.S. Provisional Patent App. No. 61/690,346 entitled "Device for limiting flow through a section of drill string", by David S. Cramer, filed Jun. 25, 2012, of which both applications are assigned to the current assignee hereof and incorporated herein by reference in their entirety.

BACKGROUND OF THE INVENTION

Field of the Disclosure

The present invention relates in general to drill strings and, in particular, to a system, method and apparatus for regulating fluid flow through a drill string.

Description of the Related Art

Conventional oil and gas drilling typically includes pumping a quantity of fluid through a pipe or drill string to a drill bit for cutting the hole in the rock. The fluid is then circulated back up though the wellbore in the annular or outer section of the hole. Drilling fluid is beneficial to the drilling process since it clears away pieces of rock that have been cut from the bottom of the wellbore. Without this cleaning action the cut pieces of rock would accumulate near the drill bit and interfere with further drilling.

In general, the higher level of fluid flow that a drilling operation can achieve, the better that cut pieces of rock or "cuttings" are cleared from the bottom of the wellbore. However, there are several factors that limit the fluid flow level. One of these factors is the amount of pressure that it takes to pump a large amount of fluid. As the drill string becomes longer or narrower, the resistance to pumping a given amount of fluid increases, which increases the need for higher pressure. With any fluid pump set up there is a limit to the amount of pressure that can be overcome in order to make the fluid flow. Accordingly, the size or type of pump can limit the available flow rate.

Another limiting factor is the capability of the downhole mud motor. Mud motors are used to make the rock cutting drill bit rotate faster than the drill pipe that it is connected to. For example, a drilling operator may desire to drill while holding the drill string stationary, or may want to rotate the drill bit faster to achieve a higher rate of rock penetration. The mud motor works in a manner similar to a turbine in that the mud that flows through the motor turns a rotor that is connected to the drill bit. Energy from the pressure of the fluid flow is converted into rotational work by the drill bit. Mud motors are usually designed such that there is a maximum amount of flow that the motors are designed to handle. Forcing excess fluid through a mud motor can damage the motor and inhibit the drilling process.

The desire to flow higher volumes of drilling fluid through the well and the need to limit the volume flow rate due to the constraints of the motor can be conflicting. It would be desirable to flow as much fluid as is desired while ensuring that the motor did not experience a rate of flow higher than its design criteria.

A conventional solution to this problem is to form annular ports in the drill string above the mud motor. By choosing the size of the ports, the amount of flow that exits through the ports and the amount of flow that continues on through the drill string into the mud motor can be approximated.

A problem with this technique is that the amount of fluid that exits through the ports varies depending on the back pressure from the mud motor. The back pressure from the mud motor is a factor of the torque that it delivers. Thus, the more torque that is needed or generated by the motor, the higher the back pressure from the motor, which diverts more fluid through the ports in the sides of the drill string. More diverted flow means less fluid is transferred down through the motor. Less fluid to the motor reduces its torque and power, which can induce a situation where the motor stalls and needs more torque to overcome its bound condition. Conversely, an off-bottom situation where there is relatively low amounts of back pressure generated by the motor because there is no drilling torque resistance can result in a higher amount of fluid passing through the motor and a lower amount of fluid exiting the drill string. This too is problematic since a low torque situation causes the motor to spin faster at a given flow rate. Increased amounts of flow will only exacerbate this situation.

Some motor manufacturers attempt to solve this problem by drilling a hole through the rotor of the mud motor so that some fluid may pass through the tool without generating torque or causing damage to the motor. Unfortunately, since the drilled hole is static and does not change its shape to account for differing flow or pressure conditions, it is subject to the same limitations as the previously described method. Thus, improvements in controlling drill string fluid flow continue to be of interest.

SUMMARY

Embodiments of a system, method and apparatus for controlling fluid flow through a drill string are disclosed. For example, an apparatus may include a housing having an axis, a radial wall with a bore extending axially therethrough, and an aperture formed in the radial wall. The aperture is in fluid communication with the bore. A piston may be located inside the housing and have an orifice configured to permit axial fluid flow through the housing. A spring may be located in the housing and be configured to axially bias the piston to a closed position.

In some embodiments, the piston is movable from the closed position wherein the piston is configured to close the aperture in the housing to substantially block fluid flow therethrough when axial fluid flow through the orifice is insufficient to overcome a spring force of the spring, and an open position wherein the piston is configured to permit fluid flow through the aperture when axial fluid flow through the orifice is sufficient to overcome the spring force of the spring and axially move the piston.

In other embodiments, a method of controlling fluid flow through a drill string may include operating the drill string to drill a hole in an earthen formation; pumping fluid through the drill string to a mud motor such that substantially all of the fluid is flows axially to the mud motor and substantially none of the fluid is radially diverted out of the drill string; and then increasing a flow rate of the fluid such that some of the fluid is diverted out of the drill string before reaching the mud motor, and a remainder of the fluid is flows axially to the mud motor.

In still other embodiments, a method of controlling fluid flow through a drill string may include operating a drill string to drill a hole in an earthen formation; pumping fluid through the drill string; closing a piston in the drill string to direct substantially all of the fluid to a mud motor; and then changing a parameter of the drill string such that the piston moves to an open position allowing at least a portion of the fluid to be diverted away from the mud motor.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
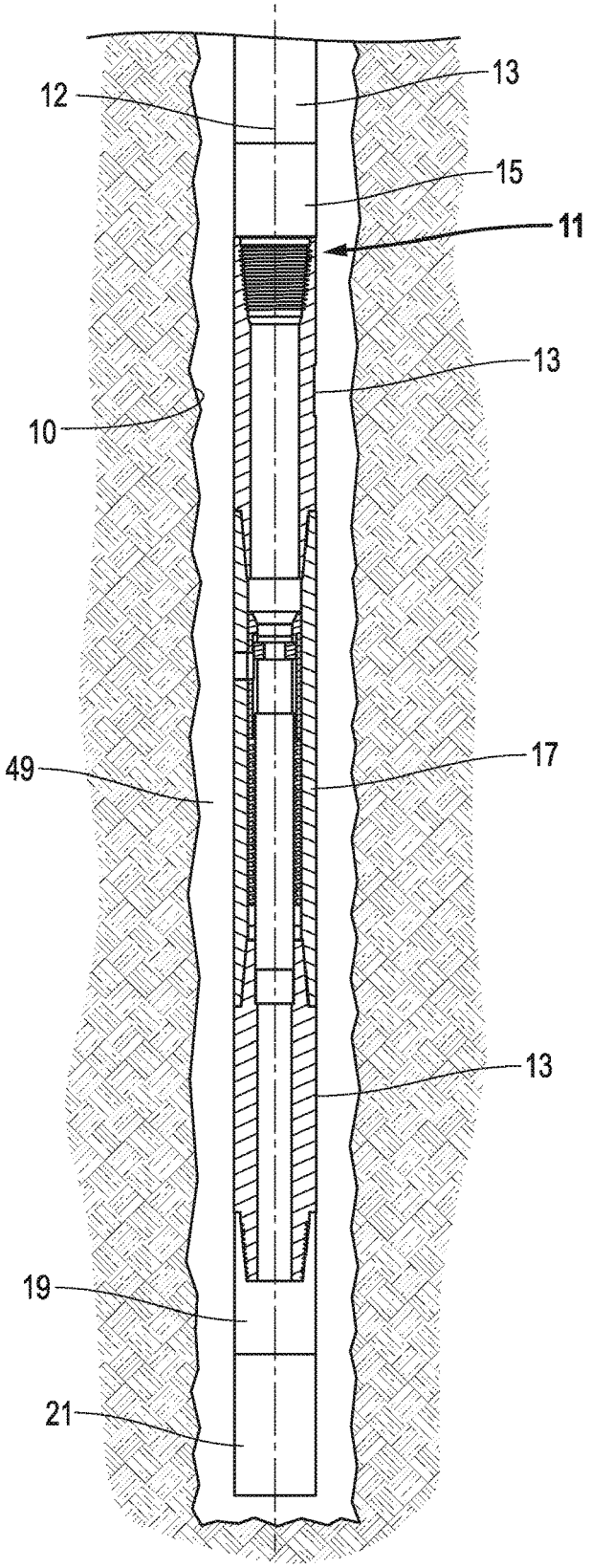
FIG. 1 is a sectional side view of an embodiment of drill string assembly.

Embodiments of a system, method and apparatus for controlling fluid flow through a drill string are disclosed. For example, FIG. 1 depicts an embodiment of a downhole tool assembly 11 for drilling a well bore 10. The downhole tool assembly 11 may comprise a variety of configurations. In one embodiment, the downhole tool assembly 11 may include an axis 12, a plurality of drill pipes 13, measurement while drilling (MWD) equipment 15, a fluid flow control tool 17, a mud motor 19 and a drill bit 21. The order or sequence of these components may be varied depending on the application. For example, the MWD equipment 15 may be located above or uphole from the drill bit 21. In some embodiments, the MWD equipment 15 may be axially relatively close (e.g., within about 100 meters) to the drill bit 21. Likewise, the MWD equipment 15 may be located above but axially relatively close to fluid flow control tool 17, such that fluid flow control tool 17 is relatively close to the drill bit 21 as well.

Figure 2:
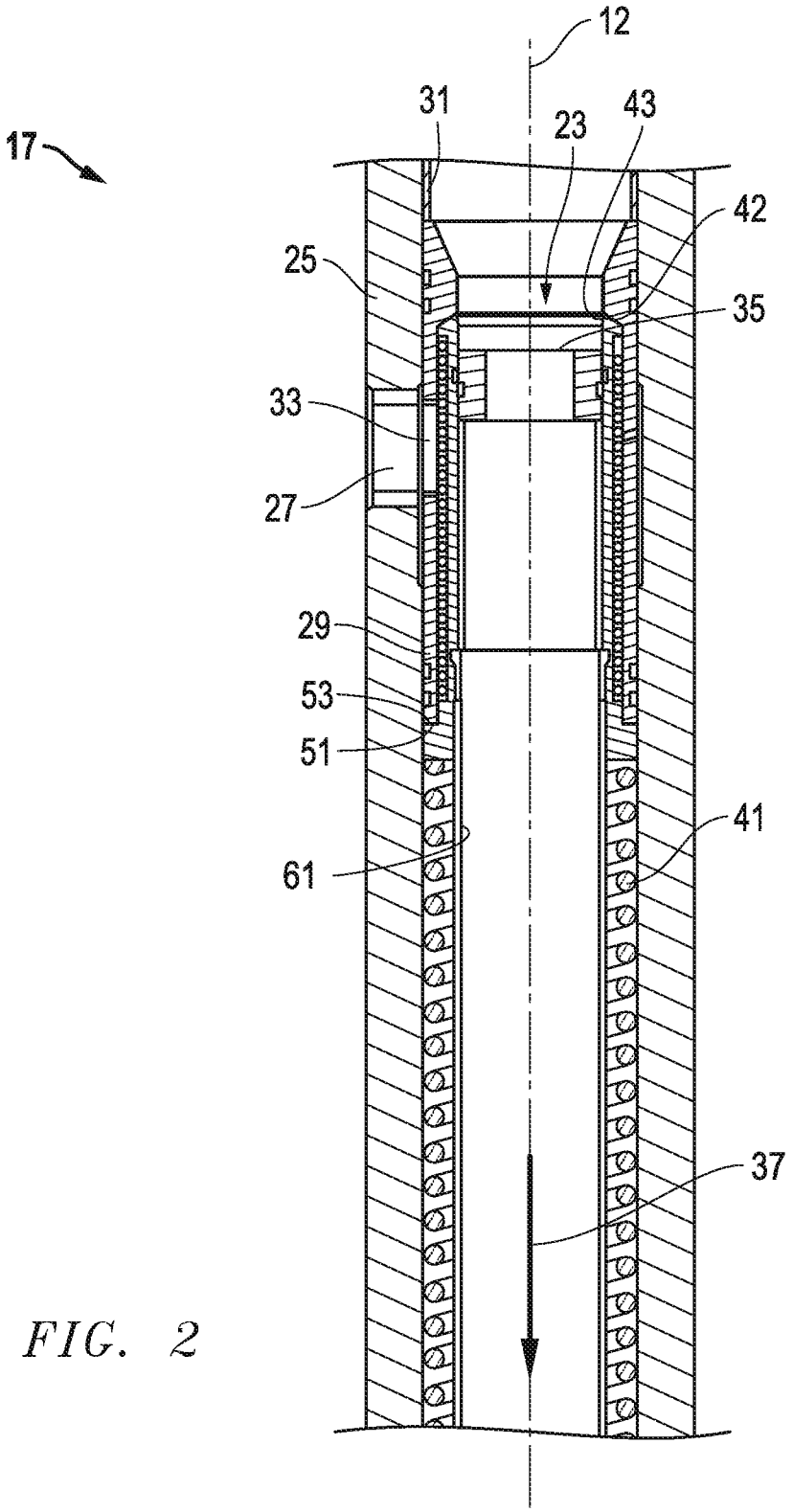
FIGS. 2-4 are sectional side views of an embodiment of a system, method and apparatus for limiting fluid flow through a drill string, illustrating a closed position, a partially open position, and a fully open position, respectively.
Figure 3:
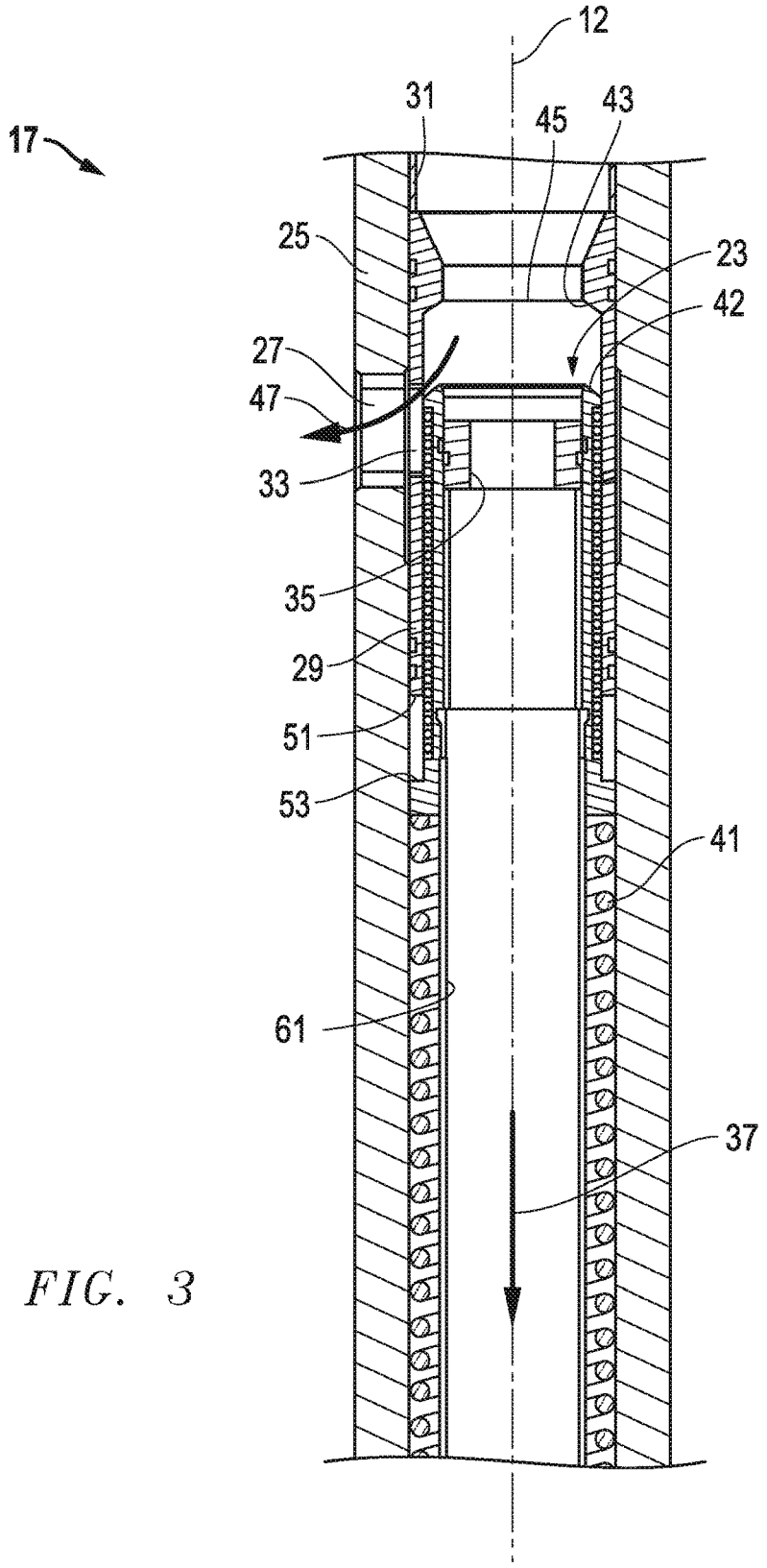
Figure 4:
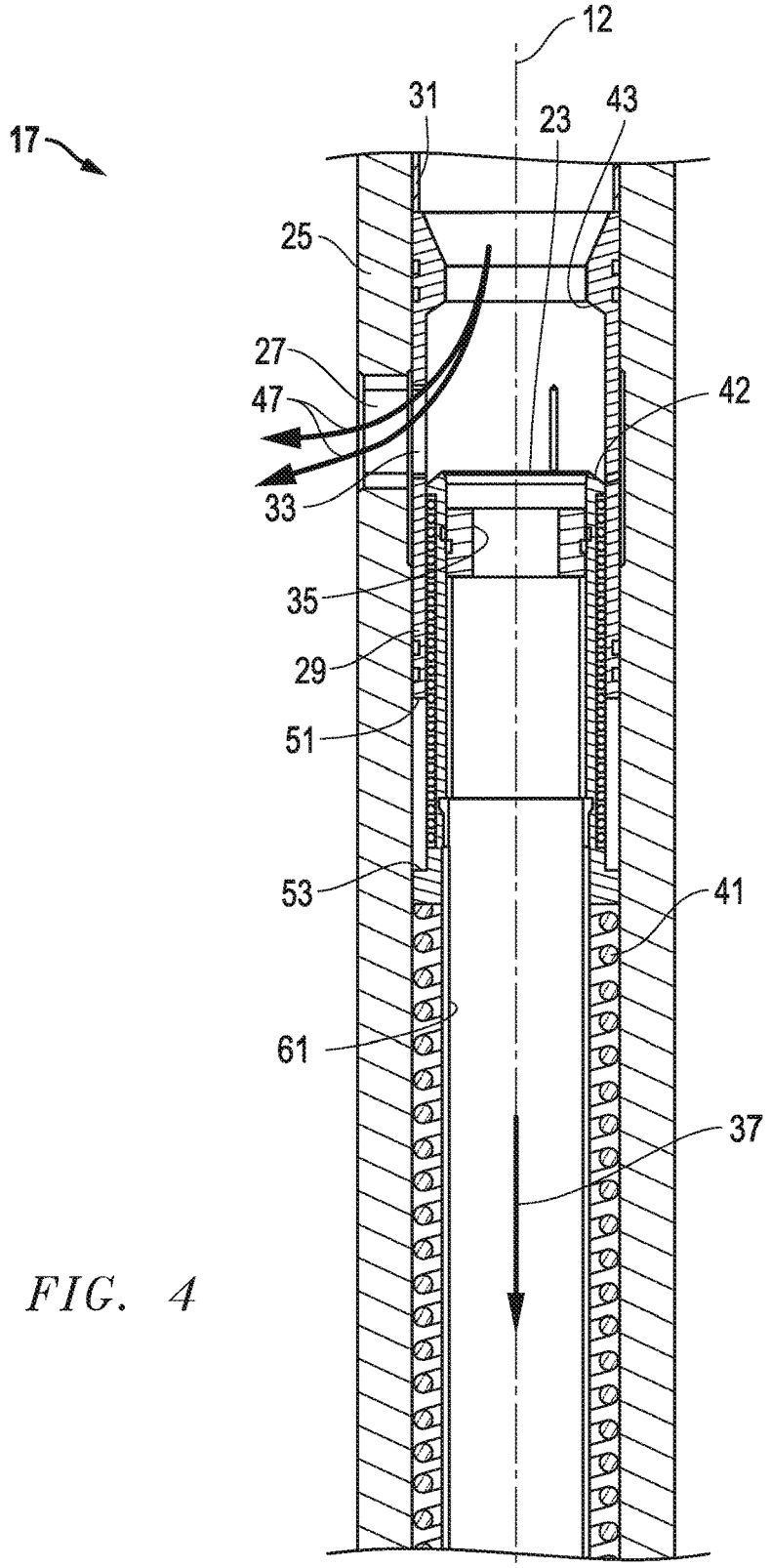

FIGS. 2-4 are enlarged views of fluid flow control tool 17. Each drawing depicts a piston 23 in a closed position (FIG. 2), a partially open position (FIG. 3) and a fully open position (FIG. 4). The fluid flow control tool 17 includes a housing 25 having an aperture 27 extending through a radial wall thereof. The aperture 27 may comprise one or more holes, slots, etc. In the illustrated embodiment, a sleeve 29 that is stationary is mounted to the inner bore 31 of the housing 25. Sleeve 29 has a sleeve aperture 33 that corresponds with aperture 27 in housing 25. In some embodiments, the sleeve aperture 33 is smaller than and complementary in shape to the aperture 27. In some versions, the sleeve 29 and sleeve aperture 33 are configured to take the brunt of fluid erosion damage away from the housing 25 and aperture 27. Sleeve 29 may be more readily replaced in fluid flow control tool 17 than housing 25. Sleeve 29 may be affixed to housing 25 such that it can be considered to be part of the housing 25.

Embodiments of the piston 23 also comprise an element 35 having an inner axial orifice. As fluid 37 flows through the orifice of element 35, it may create a pressure drop and thus a downward force on piston 23. As long as the flow rate of fluid 37 is low enough, the resultant downward force by the fluid on piston 23 does not exceed the upward force of a spring 41. Under such conditions (FIG. 2), a shoulder 42 on the piston 23 will remain against an upper stop 43 located on an inner surface of sleeve 29. In addition or alternatively, the upward axial travel of piston 23 may be limited by landing a lower shoulder 53 of piston 23 on an upper shoulder 51 of sleeve 29.

FIG. 3 illustrates the same tool with the fluid flow rate increased such that the downward force that the fluid exerts on piston 23 is equivalent to or exceeds the upward force of spring 41. Under these conditions, the piston 23 moves axially downward to the "partially open" position shown in FIG. 3. The shoulder 42 on piston 23 is located axially below upper stop 43 on sleeve 29. As the top 45 of piston 23 moves below the top of the sleeve aperture 33 in sleeve 39 (and, thus, the top of aperture 27 in housing 25), a flow path begins to open such that some of the fluid 47 escapes out the radial side of the tool 17. Fluid 47 escapes to the wellbore annulus 49 (FIG. 1) located between the outer surface of downhole tool assembly 11 and the wellbore 10. The piston 23 finds an axial equilibrium between the downward pressure from fluid 37 through the orifice of element 35 and the upward force from spring 41. In some versions, the spring rate of the spring 41 may be selected such that the balancing force is substantially constant throughout the axial range of travel of the piston 23.

Figure 7:
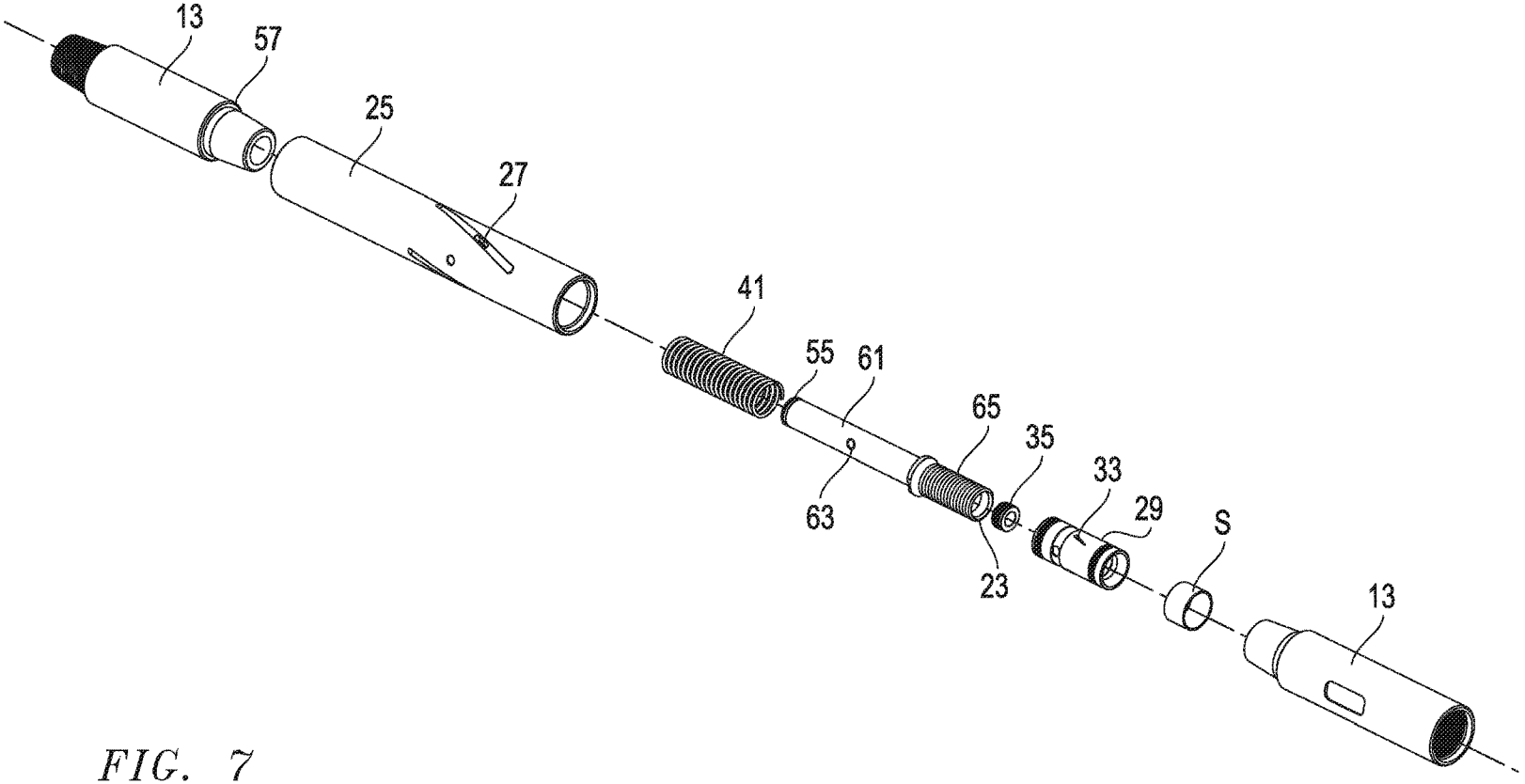
FIG. 7 is an exploded isometric view of an embodiment of a tool assembly.

FIG. 4 shows the piston 23 in a "fully open" position when it is subjected to an even larger fluid flow rate than that of FIG. 3. The fluid flow is divided between fluid 47 through the apertures 33, 27 in the side of the tool 17, and the fluid 37 flowing through the center of the tool 17. In the fully open position, the fluid flow completely overcomes the spring force of spring 41 and pushes piston 23 completely open. In this condition, fluid flow through apertures 33, 27 may be completely unobstructed by piston 23. In addition or alternatively, the downward axial travel of piston 23 may be limited by landing a lower shoulder 55 (FIG. 7) of piston 23 on an upper shoulder 57 of a sub 13.

In some embodiments, the apparatus or tool 17 may comprise a housing 25 having an axis 12, a radial wall with a bore 31 extending axially therethrough, and an aperture 27 formed in the radial wall. In some versions, the housing 25 may have has an axial length of about 3 feet to about 12 feet, and an outer diameter of about 3.5 inches to about 8 inches.

Figure 5:
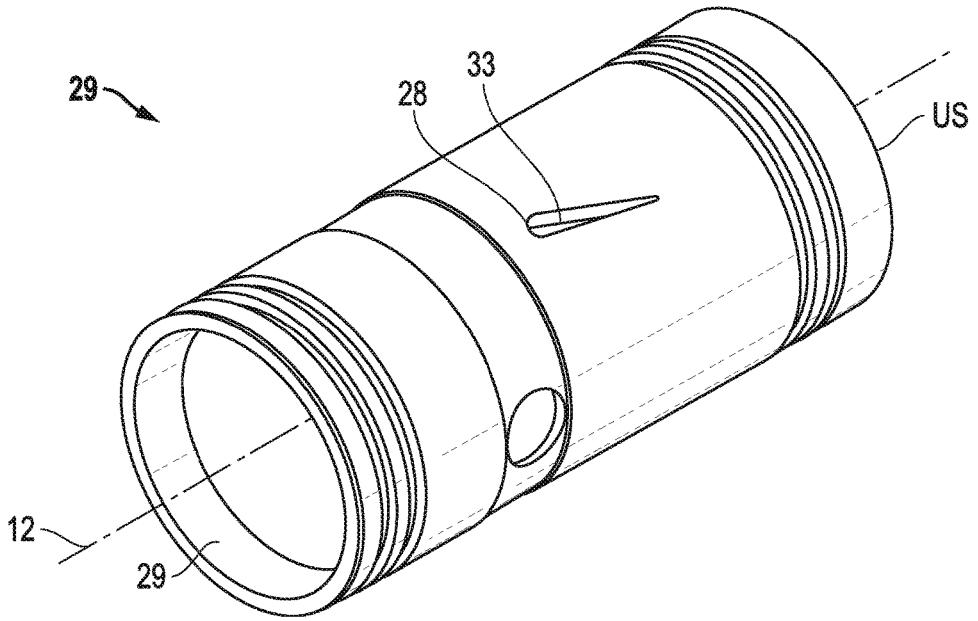
FIGS. 5 and 6 are isometric and side views, respectively, of an embodiment of a sleeve.
Figure 6:
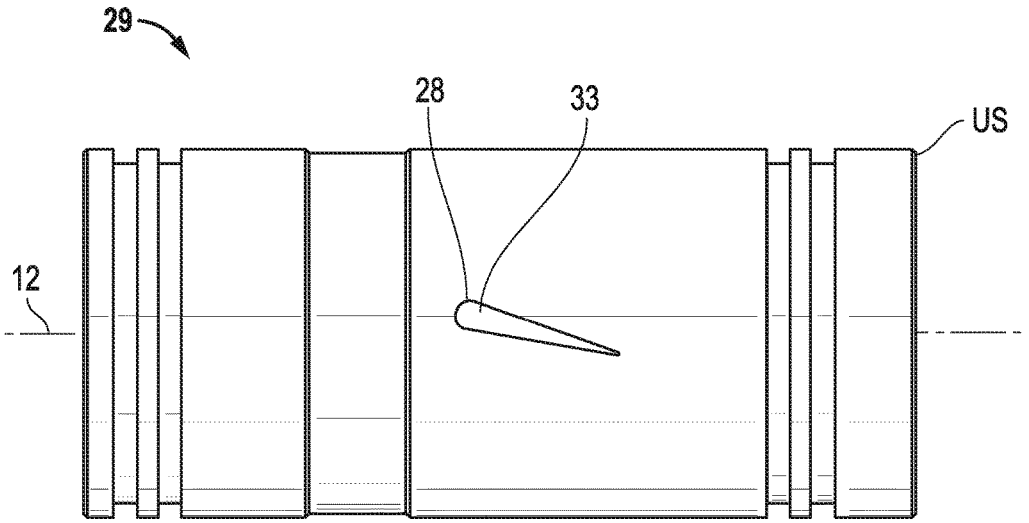

The aperture 27 may be in fluid communication with the bore 31. The aperture 27 in the housing 25 may comprise a plurality of apertures 27. The aperture 27 may comprise an elongated slot, such as the teardrop shape of sleeve aperture 33 in sleeve 29 shown in FIGS. 5 and 6. The sleeve aperture 33 (and, similarly, aperture 27) may include an upper leading edge 28 that is not greater than about 0.030 inches wide in a circumferential direction with respect to the axis 12. The aperture 27 may increasingly taper in width, such as toward a trailing edge thereof, at not greater than about 15° with respect to the axis 12. In addition, the sleeve aperture 33 (and, similarly, aperture 27) may be skewed with respect to the axis 12, as shown.

A piston 23 may be located inside the housing 25 and have the element 35 configured to permit axial fluid flow through the housing 25. A spring 41 may be located in the housing 25. The spring 41 may be configured to axially bias the piston 23 to a closed position (FIG. 2).

The piston 23 may be movable from the closed position wherein the piston 23 is configured to close the aperture 27 in the housing 25 to substantially block radial fluid flow therethrough when axial fluid flow 37 through the orifice 35 is insufficient to overcome a spring force of the spring 41. In an open position (which may include any position other than the closed position), the piston 23 may be configured to permit radial fluid flow 47 through the aperture 27 when axial fluid flow 37 through the orifice of element 35 is sufficient to overcome the spring force of the spring 41 and axially move the piston 23. In the open position, the piston 23 may be configured to permit substantially unobstructed radial fluid flow through the aperture 27.

Embodiments of the piston 23 may further comprise a partially open position, located between the closed position and the open position, wherein the piston 23 may be configured to reach a force equilibrium between the axial fluid flow 37 and the spring force such that the aperture 27 is only partially obstructed to radial fluid flow 47 by the piston 23.

The piston 23 may be configured to generate a pressure differential as fluid 37 flows through the orifice of element 35 so that the piston 23 pushes against the spring 41. The element 35 may be replaceable within a body of the piston 23, such that the body is configured to be reusable after the element 35 is replaced within the body. In some versions, the orifice of element 35 may have an inner diameter in a range of about 0.75 inches to about 1.5 inches. In addition, the piston 23 may be formed from a single material, or formed from at least two materials, one of which is harder (e.g., tungsten carbide) than the other (e.g., steel).

Embodiments of the apparatus 17 may further comprising a sleeve 29 located between the bore 31 of the housing 25 and the piston 23. The sleeve 29 may be stationary with respect to the housing 25. The piston 23 may be movable with respect to the sleeve 29 and housing 25. In some versions, both axial ends of the sleeve 29 may be sealed with respect to the bore 31 of housing 25.

The sleeve 29 may be consumable. The sleeve 29 may comprise a material that is harder than a material of the housing 25. For example, the housing may be some form of steel, and the material of sleeve 29 may comprise at least one of tungsten carbide, a ceramic, stabilized zirconia, alumina, and silica. Like the sleeve 29, the element 35 may be consumable and comprise a material that is harder than a material of the housing, and the orifice material comprises at least one of those same materials.

The piston 23 and the sleeve 29 may include a shoulder 42 and upper stop or shoulder 43, respectively, that abut each other in the closed position (FIG. 2). The shoulders 42, 43 may be axially spaced apart in the open position (FIG. 3 or 4). The shoulders 42, 43 may comprise at least one of upper shoulders and lower shoulders. In some versions, the piston 23 may have a range of axial travel in a range of about 1 inch to about 6 inches.

In addition, embodiments of the sleeve 29 may comprise a sleeve aperture 33 that registers with the aperture 27 in the housing 25. The sleeve aperture 33 may be smaller than the aperture 27 in the housing 25.

In some versions, at least some fluid leakage through the aperture 27 is permitted when the piston 23 is in the closed position. In other words, the aperture 27 is not necessarily sealed to stop fluid leaks when the piston is in the closed position. For example, up to about 5% of the fluid entering the apparatus 17 may be permitted to leak through the aperture 27 when the piston 23 is in the closed position.

The apparatus 17 may further comprise a labyrinth seal 65 (FIG. 7) between the housing 25 (or sleeve 29, if present) and the piston 23. The labyrinth seal 65 may be formed on an exterior of the piston 23, or could be on the inner surface of housing 25 or sleeve 29, if present.

Embodiments of the spring 41 may have a spring rate and may be configured to apply a force that is substantially constant over a range of axial movement of the piston. For example, the spring 41 may have a spring rate in a range of about 10 lb/in to about 70 lb/in. Examples of the spring 41 may comprise t least one of a coil spring, a Belleville spring stack and a polymer spring. In some embodiments, there is a frictional force between the housing 25 (or sleeve 29, if present) and the piston 23. The spring 41 may have a compression preload, such that the frictional force is less than about 5% of the compression preload.

The apparatus may further comprise a wash pipe 61 mounted to the piston 23. The spring 41 may be located between the bore 31 of the housing 25 and the wash pipe 61. Embodiments of the wash pipe 61 may be sealed to the piston 23 at one axial end US (FIGS. 5 and 6) and with a seal S (FIG. 7) to the housing 25 (e.g., a sub or drill pipe 13) at the other axial end. The wash pipe 61 may comprise at least one hole 63 for communicating fluid to and from the spring 41. Pressure generated by fluid flow through the hole 63 is configured to act as a damper for the axial motion of the piston 23.

In some embodiments, the spring rate may be sufficiently low and the spring 41 is preloaded such that the force provided by the spring 41 is substantially constant over its operating range. In addition, the spring force may be sufficiently high such that at least about 95% of the resistance to downhole movement of the piston 23 may be provided by the spring 41 and not by unpredictable forces like friction.

In other embodiments of the tool 17, the amount of fluid flow through the center (i.e., the orifice of element 35) of the tool 17 is substantially constant regardless of the fluid pressure, flow rate, fluid density, etc. The spring rate may be selected such that it is between about 10% and about 15% of the compression preload on the spring 41. Such a spring 41 may have a relaxed length that is about 2.5 times its compressed length. For example, a spring 41 having a spring rate of 25 lb/in may be compressed to provide a spring force or pre-load of 250 lbs in the compressed state (i.e., when the tool 17 is in the closed position). In order to move the piston 23 a distance of 1.5 inches, the spring force increases by 1.5 times the spring rate. In this example, 250 lbs+(1.5 in×25 lb/in)=282 lbs. Since the fluid pressure difference through the orifice of element 35 increases with the square of the flow rate, the axial fluid flow rate through the orifice of element 35 of the tool 17 can be considered to be substantially constant. The actual amount of increase in flow rate at the point where the piston moves to the point where the apertures are fully open can be calculated as increasing by a factor of the square root of the ratio of spring force on the piston in the open position to the spring force on the piston in the closed position, or:

$$\text{Flow(open)}=\text{Flow(closed)}\times\text{sqrt}(282/250)$$

$$\text{Flow(open)}=\text{Flow(closed)}\times 1.06.$$

So, even though the spring force increases by 13% (282/250) as the piston moves into an open position, the flow that is allowed to pass axially through the tool only increases by 6%.

Should the tool be configured such that the rate was 15% of the preload, the preceding calculation would be done as follows:

Flow(open)=Flow(closed)×sqrt(306.25/250)

Flow(open)=Flow(closed)×1.10.

Therefore, in the case where the spring rate is configured to be 15% of the preload value, with a 1.5" axial movement of the piston the axial flow through the tool increases by 10%.

In other embodiments, a method of controlling fluid flow through a drill string may comprise operating the drill string to drill a hole in an earthen formation; pumping fluid through the drill string to a mud motor such that substantially all of the fluid is flows axially to the mud motor and substantially none of the fluid is radially diverted out of the drill string; and then increasing a flow rate of the fluid such that some of the fluid is radially diverted out of the drill string before reaching the mud motor, and a remainder of the fluid is flows axially to the mud motor. The valve opening may be proportional to the fluid flow rate. Pumping may comprise insufficient fluid pressure to overcome a mechanical force biasing a valve to a closed position. In some versions, increasing the flow rate may comprise opening a valve with fluid pressure that overcomes a mechanical force biasing the valve to a closed position. In other versions, increasing the flow rate may comprise variably controlling an amount of fluid that is radially diverted and the remainder of the fluid flowing axially to the mud motor.

Embodiments of a method of controlling fluid flow through a drill string may comprise operating a drill string to drill a hole in an earthen formation; pumping fluid through the drill string; closing a piston in the drill string to direct substantially all of the fluid to a mud motor; and then changing a parameter of the drill string such that the piston moves to an open position allowing at least a portion of the fluid to be diverted away from the mud motor.

When operating the tool, the impact of tool 17 that will be noticed at the surface of the well is that once the flow rate is increased to the point that the tool opens, the stand pipe pressure (or surface operating pressure) will increase more slowly with any further flow rate increases. Thus, once the piston in the tool begins to open (i.e., from one of the partially open positions to the fully open position), the fluid pressure does not substantially increase even with an increase in fluid flow rate. This is due to the fact that pressure of the fluid at the surface is a function of the drilling fluid flow rate through the surface piping, the drill pipe, and the bottom hole assembly (BHA, or MWD, mud motor, drill bit, etc.). As fluid flow opens the tool, an increasing amount of fluid bypasses the BHA through the radial aperture. Thus, even though the fluid flow rate may increase, the fluid pressure through the BHA is substantially constant. Increases in fluid pressure can originate from more fluid flow through the surface piping and the drill string.

For example, the tool 17 may be configured with the following constants. The ID of most of the tool components is about 2 inches, which will be the number used in flow calculations for Bernoulli's equation. The piston/orifice combination may be considered a single part for these purposes. Further, for the purposes of calculation it can be thought of as a toroid (donut) shape with a cross-sectional area that is a function of its ID and OD and will, in conjunction with the orifice pressure drop (delta P), determine the downward force that the piston applies to the spring. The OD of the piston may be 3 inches. The ID of the orifice may be determined based on flow rate.

In this example, the spring has a spring rate of 25 lb/in and is compressed (preloaded) in the closed state such that it applies a force of 200 lb on the piston. The spring may be compressed 8 inches for this example. Incidentally, and not considered in this calculation, the force on the piston increases slightly as it moves downwards. If the piston moves down by one inch the force will increase by 25 lbs to 225 lbs.

In one example, the tool may be set up so that only 250 gpm of fluid will go axially through the tool and that any increase in flow rate will be allowed to exit through the radial apertures. A flow rate of 250 gallons per minute is equivalent to 962.5 cubic inches per second. In this example, the density of the fluid flowing through the tool can be about 10 ppg (pounds per gallon), or 6.9 slugs/cubic ft.

This may comprise an iterative calculation (where the orifice diameter determines the pressure drop at a given flow rate, but it also can determine the cross sectional area over which the pressure is applied. Thus, the calculation could be performed many times. However, the ID does not drastically affect the area as much as it affects pressure drop. Accordingly, a good starting estimate for orifice size is sufficient to bring the calculation to a satisfactory conclusion.

For example, if the orifice ID may be estimated at 1.2 inches. If the piston has an OD of 3.00 inches, then the cross sectional area is:

*A*=*pi**((Piston *OD*/2)squared−(Orifice *ID*/2) squared)=5.93 sqin.

This is the area that the delta P acts on to push against the spring.

With this area, the pressure drop (delta P) that will start to move the spring is:

deltaP=preload force/cross sectional area.

So, delta P=200 lb/5.93 sqin=33.7 psi. Or, 4853 lbs/square foot.

The velocity of the fluid may be determined as it goes through the 2" ID section of the tool. If the design goal is 250 gpm, velocity may be calculated as V=Q/A where Q is the volume flow rate. For consistent units, the calculation in feet per second is: for flow rate 962.5 cubic inches per second, and area is 3.14 sq in, the inlet velocity is 306.4 in/second or 25.5 ft/second.

Bernoulli's equation for pressure drop across an orifice is:

Delta *P*=(density×(orifice fluid velocity)squared)/2−density×(inlet fluid velocity)squared)/2

The delta P and inlet velocity are known, and the equation may be configured for orifice velocity.

Orifice Velocity=sqrt((2*delta *P*/density)+(inlet fluid velocity)squared)

Thus, Orifice velocity=sqrt((2*4853/(6.9))+(25.4) squared)

Orifice Velocity=45.3 ft/s

Converted to in/s, velocity is 543.6 in/s

And back calculating an orifice area, A=Q/V, so A=962.5/543.6=1.77 sqin.

And finally, the orifice diameter becomes sqrt (4*Area/pi)=sqrt(4*1.77/3.14159)

Diameter=1.50 inches.

This calculation provides an orifice diameter of 1.50 inches gives a pressure drop of 33.7 psi at a flow rate of 250 gallons per minute. This calculation is slightly different from the original estimate of 1.20 inches. The area difference that this equates to is 5.3 inches squared as opposed to the original estimate of 5.93 inches, which is a difference of 0.63 square inches or 10%. The formula may be recalculated with this new estimate to yield a more precise value. With a new estimate of a 1.5 inch orifice, recalculating the numbers provides an orifice value of 1.48 inches. A value of 1.48 inches is sufficiently close to the previous iteration value of 1.50 that the calculation can be considered to be complete.

Embodiments of the tool described herein solve the problems described above with a piston assembly that moderates the amount of flow that exits the tool. The holes in the sides of the tool can be partially closed to change their size. As the holes are made smaller, a larger portion of the flow is directed downward through the motor. As the holes are enlarged, more of the flow is directed radially outward to bypass the motor and yet still aid in the hole cleaning process. The moderation of hole size can be done very quickly, typically in a fraction of a second. Rapid hole size selection addresses issues such as motor stalls and stick-slip, which can occur and can be resolved very quickly.

In some embodiments, the piston assembly comprises a sleeve that slides axially to open or close one or more holes in the tool. The holes may comprise a variety of shapes, such as axially elongated shapes. An orifice is attached to the sleeve to generate a pressure difference across the orifice that depends on the amount of fluid flow. Pushing the sleeve and orifice upwards is a spring with a spring rate that is as low as is reasonable given the other mechanical constraints of the tool. The spring may be preloaded such that a high amount of force is required to make the sleeve initially move from the seated position, but relatively low additional force may be required to push the sleeve down to its fully open position. Thus, the position of the piston may be correlated with the amount of fluid flow that exits through the side of the tool, rather than the amount of flow that is directed down hole to the motor. Accordingly, the spring may have a relatively constant force over its range of travel. The downward force from the fluid is generated by flow through the orifice. Since the downward force balances with the upward spring force, the flow through the orifice may remain relatively constant as well. Fluid flow that is in excess of an amount required to push the sleeve down may be directed out the side of the tool.

A motor "stalls" when its rotor stops turning and fluid flow is backstopped such that the fluid stops flowing through the motor. With the embodiments described herein, motor stalls are avoided since pressure drops through the orifice allow the sleeve to move upward to close the radial holes and direct more fluid down through the orifice to the motor where it is needed to correct the stall.

Change in the size of the radial holes or slots may be effected through the use of piston that is constructed of a hard material (e.g., tungsten carbide) and fits snugly inside of the housing. The tungsten carbide piston may be coupled with a tungsten carbide housing to resist fluid erosion even with very abrasive mud types.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. An apparatus, comprising:

a housing having an axis, a radial wall with a bore extending axially through the radial wall, and an aperture formed in the radial wall, the aperture being in fluid communication with the bore;

a component located inside the housing and having an orifice configured to permit axial fluid flow through the housing, the orifice is located in an element that is mounted to and removable from the component, and the element is consumable and comprises a material that is harder than a material of the housing;

a bias device located in the housing and configured to bias the component to a closed position;

the component is movable from the closed position wherein the component is configured to substantially close the aperture in the housing to substantially block fluid flow therethrough when downhole axial fluid flow through the orifice is insufficient to overcome a bias of the bias device, and an open position wherein the component is configured to permit fluid flow through the aperture when downhole axial fluid flow through the orifice is sufficient to overcome the bias of the bias device and move the component; and in the open position, the orifice is downstream relative to the aperture in the radial wall.

2. The apparatus of claim 1, wherein downhole axial fluid flow through the orifice is configured to be unobstructed in both the closed position and the open position, and up to about 5% of the fluid is permitted to leak through the aperture when the component is in the closed position.

3. The apparatus of claim 1, further comprising a sleeve located between the bore of the housing and the component, the sleeve is configured to be stationary relative to the housing, and the component is configured to be movable relative to the sleeve.

4. The apparatus of claim 3, wherein the sleeve is consumable and comprises a sleeve material that is harder than a material of the housing.

5. The apparatus of claim 3, wherein the component and sleeve have shoulders that are configured to abut each other in the closed position and the shoulders are configured to be axially spaced apart in the open position.

6. The apparatus of claim 3, wherein the sleeve comprises a sleeve aperture that registers with the aperture in the housing, and the sleeve aperture is smaller than the aperture in the housing.

7. The apparatus of claim 1, wherein the element is replaceable within a body of the component, such that the body is configured to be reusable after the element is replaced within the body.

8. The apparatus of claim 1, wherein the bias device is configured to apply force that is substantially constant over a range of movement of the component.

9. The apparatus of claim 1, wherein at least some fluid leakage through the aperture is permitted when the component is in the closed position; and the component further comprises:

a partially open position located between the closed position and the open position, and in the partially open position the component is configured to reach a force equilibrium between the axial fluid flow and the bias such that the aperture is only partially obstructed to fluid flow by the component.

10. The apparatus of claim 1, further comprising a wash pipe mounted to the component, the bias device is located between the bore of the housing and the wash pipe, the wash pipe is sealed to the component and the housing, and the wash pipe comprises a hole that is configured to communicate fluid to and from the bias device such that pressure generated by fluid flow through the hole is configured to act as a damper.

11. A downhole tool system for a well, comprising:

a drill pipe having an axis;

a mud motor coupled to the drill pipe;

a drill bit coupled to the mud motor;

a housing coupled to the drill pipe uphole from the mud motor, the housing having an axis, a radial wall with a bore extending axially through the radial wall, and an aperture formed in the radial wall, the aperture being in fluid communication with the bore and an annulus between the drill pipe and the well;

a component located inside the housing and having an orifice configured to permit downhole axial fluid flow through the housing;

a bias device located in the housing, the bias device being configured to bias the component to a closed position;

a wash pipe mounted to the component, the bias device is located between the bore of the housing and the wash pipe, the wash pipe is sealed to the component and the housing, and the wash pipe comprises a hole that is configured to communicate fluid to and from the bias device such that pressure generated by fluid flow through the hole is configured to act as a damper;

the component is configured to be movable from the closed position wherein the component is configured to substantially close the aperture in the housing to substantially block fluid flow therethrough when downhole axial fluid flow through the orifice is insufficient to overcome a bias of the bias device, and an open position wherein the component is configured to permit fluid flow through the aperture when downhole axial fluid flow through the orifice is sufficient to overcome the bias of the bias device and move the component; and in the open position, the orifice is downstream relative to the aperture in the radial wall.

12. The downhole tool system of claim 11, further comprising measurement while drilling (MWD) equipment coupled to the drill pipe, the housing is located axially between the MWD equipment and the drill bit;

at least some fluid leakage through the aperture is permitted when the component is in the closed position; and the bias device is configured to apply force that is substantially constant over a range of movement of the component.

13. The downhole tool system of claim 11, wherein the housing is located axially within about 100 meters of the drill bit, and up to about 5% of the fluid is permitted to leak through the aperture when the component is in the closed position.

14. A method of controlling fluid flow in a well, comprising:

operating a drill string to drill a hole in an earthen formation;

pumping fluid through the drill string to a mud motor such that substantially all of the fluid flows through an orifice to the mud motor and substantially none of the fluid is diverted out of the drill string through a radial aperture; and then increasing a flow rate of the fluid through the drill string such that at least some of the fluid is diverted out of the radial aperture before reaching the mud motor, and a remainder of the fluid flows through the orifice to the mud motor, and the orifice is downstream relative to the radial aperture; and downhole axial fluid flow through the orifice is unobstructed in both a closed position and an open position, and up to about 5% of the fluid is permitted to leak through the radial aperture when a component is in the closed position.

15. The method of claim 14, wherein pumping comprises insufficient fluid pressure to overcome a mechanical force biasing a valve to the closed position.

16. The method of claim 14, wherein increasing the flow rate comprises opening a valve with fluid pressure that overcomes a mechanical force biasing the valve to the closed position.

17. The method of claim 14, wherein increasing the flow rate comprises variably controlling an amount of fluid that is diverted out of the drill string, and the remainder of the fluid flowing to the mud motor.

18. A method of controlling fluid flow in a well, comprising:

operating a drill string with a mud motor to drill a hole having an axis in an earthen formation;

pumping fluid through the drill string to the mud motor;

moving a component having an orifice away from the mud motor to direct substantially all of the fluid through the orifice toward the mud motor, the orifice is located in an element that is mounted to and removable from the component, and the element is consumable and comprises a material that is harder than a material of a housing; and then changing a parameter of the drill string such that the component overcomes a bias device resisting axial downhole movement of the component, such that the component moves axially toward the mud motor to allow at least a portion of the fluid to be diverted through a radial aperture and away from the mud motor, and the orifice is downstream relative to the radial aperture in a radial wall; and downhole axial fluid flow through the orifice is unobstructed in both a closed position and an open position.

19. The method of claim 18, wherein the bias device is configured to apply force that is substantially constant over a range of axial movement of the component; and up to about 5% of the fluid is permitted to leak through the radial aperture when the component is in a closed position.

* * * * *